US009657548B2

(12) United States Patent
Budde et al.

(10) Patent No.: US 9,657,548 B2
(45) Date of Patent: May 23, 2017

(54) APPARATUS AND METHODS OF RUNNING CASING IN A DUAL GRADIENT SYSTEM

(71) Applicant: Weatherford Technology Holdings, LLC, Houston, TX (US)

(72) Inventors: Marcel Budde, Vlaardingen (NL); Brent J. Lirette, Cypress, TX (US); Michael Logiudice, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 486 days.

(21) Appl. No.: 14/179,278

(22) Filed: Feb. 12, 2014

(65) Prior Publication Data

US 2014/0224487 A1 Aug. 14, 2014

Related U.S. Application Data

(60) Provisional application No. 61/763,827, filed on Feb. 12, 2013.

(51) Int. Cl.

| | |
|---|---|
| ***E21B 33/14*** | (2006.01) |
| ***E21B 33/13*** | (2006.01) |
| ***E21B 33/16*** | (2006.01) |
| ***E21B 21/00*** | (2006.01) |
| ***E21B 21/08*** | (2006.01) |
| ***E21B 43/10*** | (2006.01) |

(52) U.S. Cl.

CPC ..... *E21B 33/13* (2013.01); *E21B 21/001* (2013.01); *E21B 21/08* (2013.01); *E21B 33/16* (2013.01); *E21B 43/101* (2013.01)

(58) Field of Classification Search

CPC ..... E21B 33/14; E21B 43/10; E21B 33/076; E21B 43/101; E21B 23/08; E21B 33/143

See application file for complete search history.

(56) References Cited

U.S. PATENT DOCUMENTS

| | | | | |
|---|---|---|---|---|
| 4,310,058 | A * | 1/1982 | Bourgoyne, Jr. | E21B 21/00 175/207 |
| 4,577,689 | A * | 3/1986 | Dotson | E21B 49/006 166/250.1 |
| 5,553,667 | A | 9/1996 | Budde et al. | |
| 5,787,979 | A | 8/1998 | Giroux et al. | |
| 5,813,457 | A | 9/1998 | Giroux et al. | |
| 6,009,944 | A | 1/2000 | Gudmestad | |
| 6,244,350 | B1 | 6/2001 | Gudmestad et al. | |
| 6,283,213 | B1 * | 9/2001 | Chan | E21B 33/13 166/291 |
| 6,311,771 | B1 | 11/2001 | Gudmestad et al. | |

(Continued)

OTHER PUBLICATIONS

PCT Partial International Search Report for PCT/US2014/016129 dated Dec. 17, 2015.

(Continued)

*Primary Examiner* — Kipp Wallace

(74) *Attorney, Agent, or Firm* — Patterson & Sheridan, LLP

(57) ABSTRACT

A method of running casing in a dual gradient system includes lowering a casing into a low density fluid region and allowing the low density fluid to enter the casing; releasing a plug into the casing; supplying a high density fluid behind the plug; and lowering the casing into a high density fluid region until target depth is reached.

24 Claims, 5 Drawing Sheets

(56) References Cited

U.S. PATENT DOCUMENTS

| | | | | |
|---|---|---|---|---|
| 6,318,472 | B1 * | 11/2001 | Rogers | E21B 23/04 166/208 |
| 6,328,107 | B1 | 12/2001 | Maus | |
| 6,419,015 | B1 | 7/2002 | Budde et al. | |
| 6,425,442 | B1 * | 7/2002 | Latiolais, Jr. | E21B 17/14 166/177.4 |
| 6,554,068 | B1 | 4/2003 | Chatterji et al. | |
| 6,799,638 | B2 | 10/2004 | Butterfield, Jr. | |
| 6,802,372 | B2 | 10/2004 | Budde | |
| 7,182,135 | B2 | 2/2007 | Szarka | |
| 7,789,162 | B2 * | 9/2010 | Keller | E21B 34/06 166/313 |
| 8,327,937 | B2 | 12/2012 | Giem et al. | |
| 8,789,582 | B2 | 7/2014 | Rondeau et al. | |
| 2010/0163235 | A1 * | 7/2010 | Mootoo | E21B 43/045 166/278 |
| 2010/0294503 | A1 * | 11/2010 | Laurel | E21B 33/16 166/335 |
| 2011/0036588 | A1 * | 2/2011 | Heironimus | E21B 21/001 166/345 |
| 2011/0061872 | A1 * | 3/2011 | Mix | E21B 21/08 166/363 |
| 2013/0112410 | A1 | 5/2013 | Szarka et al. | |
| 2013/0292135 | A1 | 11/2013 | Jordan et al. | |

OTHER PUBLICATIONS

Australian Patent Examination Report dated Apr. 5, 2016, for Australian Patent Application No. 2014216312.

* cited by examiner

APPARATUS AND METHODS OF RUNNING CASING IN A DUAL GRADIENT SYSTEM

BACKGROUND OF THE INVENTION

Field of the Invention

Embodiments of the present invention generally relate to running casing into a dual gradient well.

Description of the Related Art

Drilling operations that use two different fluid densities or mud weights (Dual Gradient Drilling Systems) have been used to construct subsea wells. See for example, U.S. Pat. Nos. 6,536,540; 6,843,331; and 6,926,101. Benefits of a dual gradient drilling system include reduction of the hydrostatic pressure in the well annulus above the bottom or at a previous casing point while simultaneously maintaining an equivalent hydrostatic pressure at the bottom of the hole as a single gradient fluid system.

One challenge of using a dual gradient system is the process of running in casing. For example, the process of running in casing may cause a pressure surge that may induce fluid losses that would jeopardize the well. Also, the mud weight needed to control pressures in the well must be carefully monitored against the pressure that may induce formation breakdown in the annulus. Formation breakdown may also cause undesired fluid losses to the formation between a casing shoe and total depth.

There is a need, therefore, for systems and methods for running casing in a well with a dual gradient system, which minimize the pressure effects upon the formation.

SUMMARY OF THE INVENTION

A method of running casing in a dual gradient system includes lowering a casing into a low density fluid region and allowing the low density fluid to enter the casing; releasing a plug into the casing; supplying a high density fluid behind the plug, thereby urging the low density fluid out of the casing; and lowering the casing into a high density fluid region until target depth is reached. In one embodiment, the method includes operating a pump to maintain the dual gradient effect. In another embodiment, the method includes pumping the high density fluid out of the casing until the hydrostatic head of the high density fluid is substantially the same as a hydrostatic head of the low density fluid.

In another embodiment, a plug includes a housing; a plurality of fins disposed on an exterior of the housing; a bore extending through the housing; a catcher attached to the bore; and a piston releasably attached to the catcher, wherein the piston forms a seal with the catcher to selectively block fluid flow through the bore.

In another embodiment, a method of running casing in a dual gradient system includes lowering a casing into a low density fluid region and allowing a low density fluid to enter the casing; supplying a high density fluid behind the low density fluid; displacing the low density fluid out of a bottom end of the casing; and lowering the casing into a high density fluid region until target depth is reached.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
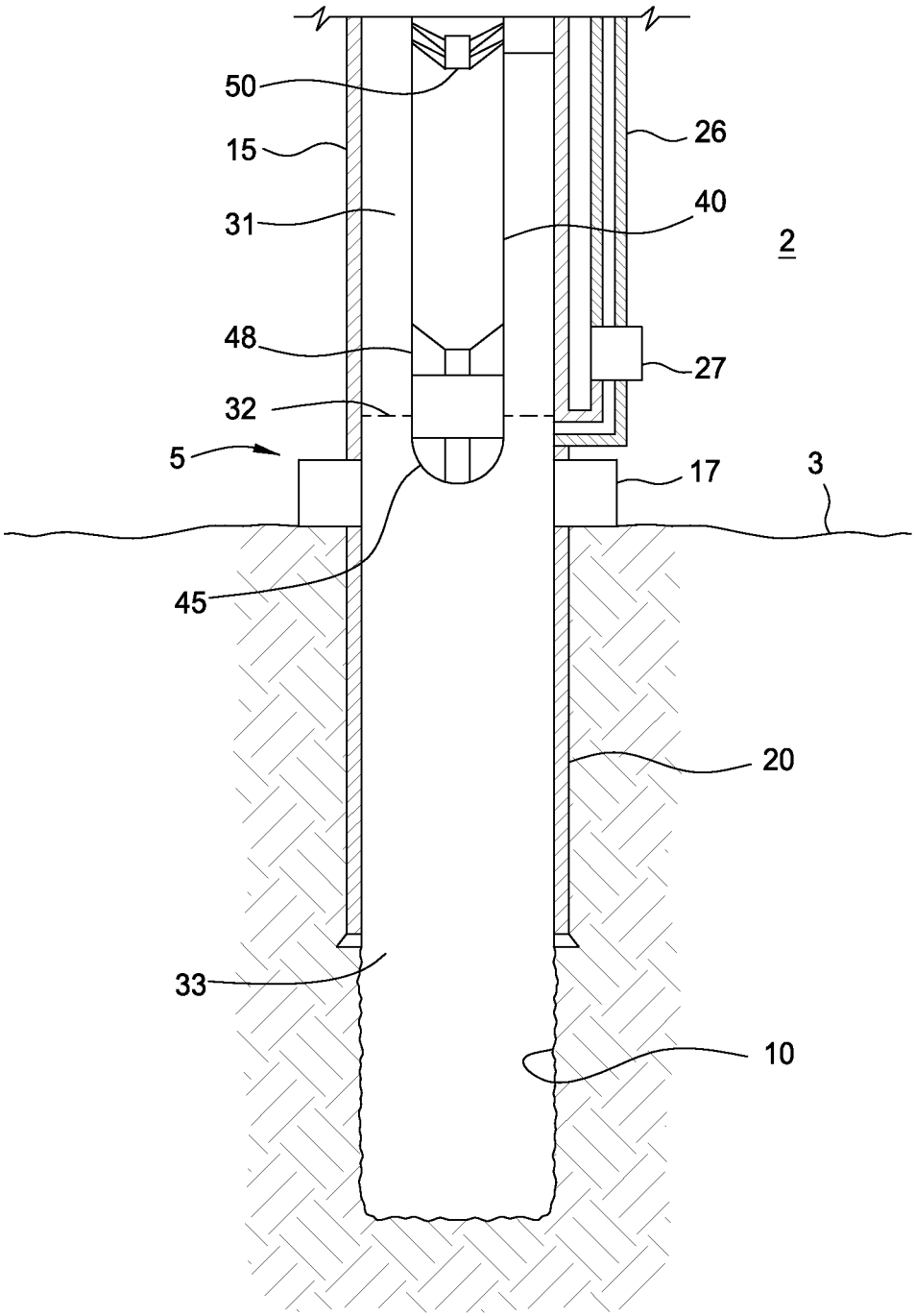
FIG. 1 illustrates an exemplary dual gradient system.

FIG. 1 illustrates an exemplary well operating under a dual gradient fluid system (also referred to herein as "DGS"). The DGS may be used to drill the wellbore 10. A subsea riser 15 extends from a surface or semi-submerged vessel (not illustrated) through seawater 2 and connects to a wellhead 17 on the sea floor 3. In one embodiment, the riser 15 may connect to a blow out preventor (not shown) in the wellhead 17. A casing 20 extends below the wellhead 17 and is supported by cement. An uncased or open-hole portion of the wellbore 10 is shown below the casing 20.

In one embodiment of the dual gradient system, a low density fluid 31 is disposed in the riser 15, and a high density fluid 33 is disposed in the casing 20 and the uncased portion of the wellbore 10. An interface 32 exists between the low density fluid 31 and the high density fluid 33. The interface 32 may or may not be as clearly defined as depicted in the Figures, and in some embodiments, may contain a mixture of low and high density fluids 31, 33. As used herein, the terms "low density fluid" and "high density fluid" simply mean that the "low density fluid" has a lower density than the "high density fluid" in the well. In one embodiment, the high density fluid may have a density that is at least 5 percent more than the low density fluid. In certain embodiments, the high density fluid may be 10, or 15, or 20, or 25, or 30, or more percent higher, i.e., heavier, than the low density fluid. The high and low density fluids may be a mud. The high or low density muds may be a water-based mud, an oil-based mud, a synthetic oil-based mud, and combinations thereof. In another embodiment, the low density fluid may be seawater or a viscous water. In one example, the density of the high density mud may be between 11 to 21 pounds per gallon (ppg). The density of the low density mud may be between 5 to 10 ppg; more preferably, the density of the fluid in the riser 15 is approximately the same as the seawater outside of the riser 15.

A return line 26 is connected to the wellhead 17 or riser 15 for removing fluid in the region of the interface 32. A lift pump 27 is coupled to the return line 26 to facilitate removal of the fluid proximate the interface 32. In one embodiment, the pump 27 may be operated to maintain the pressure conditions in the wellbore 10. For example, if the wellbore is in an underbalanced pressure condition, then the pump 27 may be operated to maintain that condition. Alternatively, if the wellbore is in an overbalanced pressure condition, then the pump 27 may be operated to maintain that condition. In another embodiment, the pump 27 may be configured to automatically turn on or off in response to a change in the pressure condition of the wellbore. In another embodiment, the return line 26 may be used to supply a fluid such as low or high density fluids into the wellbore.

In one embodiment, the casing 40 to be run-in may include an autofill float device 45 such as a collar or a shoe coupled to a lower portion of the casing 40. The float shoe 45 is adapted to allow fluid to flow into the casing 40 during run-in. The float shoe 45 may be converted to a one way valve that only allows fluid to flow out of the casing 40. In one embodiment, the float shoe 45 may be converted in response to a predetermined pressure. For example, the float shoe 45 may be configured to convert at a pressure between 500 psi to 700 psi and a flow rate between 5 to 8 bpm. Any suitable autofill float shoe known to one of ordinary skill in the art may be used. An exemplary autofill float shoe is the Large Bore Auto-Fill sold by Weatherford International Ltd located in Houston, Tex.

In another embodiment, a landing collar 48 for receiving a pump down plug 50 may be disposed above the float shoe 45. The landing collar 48 may be any suitable landing collar known to a person of ordinary skill in the art. The pump down plug 50 may be used to separate the two different types of fluids, such as separating low and high density fluids. The pump down plug 50 may be adapted to receive another plug such as a bottom plug during a cementing operation. In one example, the pump down plug includes a rupturable membrane blocking fluid flow through a bore of the plug. During operation, the pump down plug separates a fluid in front of the plug from a fluid behind the plug. After the pump down plug lands in the landing collar, pressure above the plug is increased to break the rupturable membrane, thereby allow fluid flow through the bore of the plug.

Figure 2:
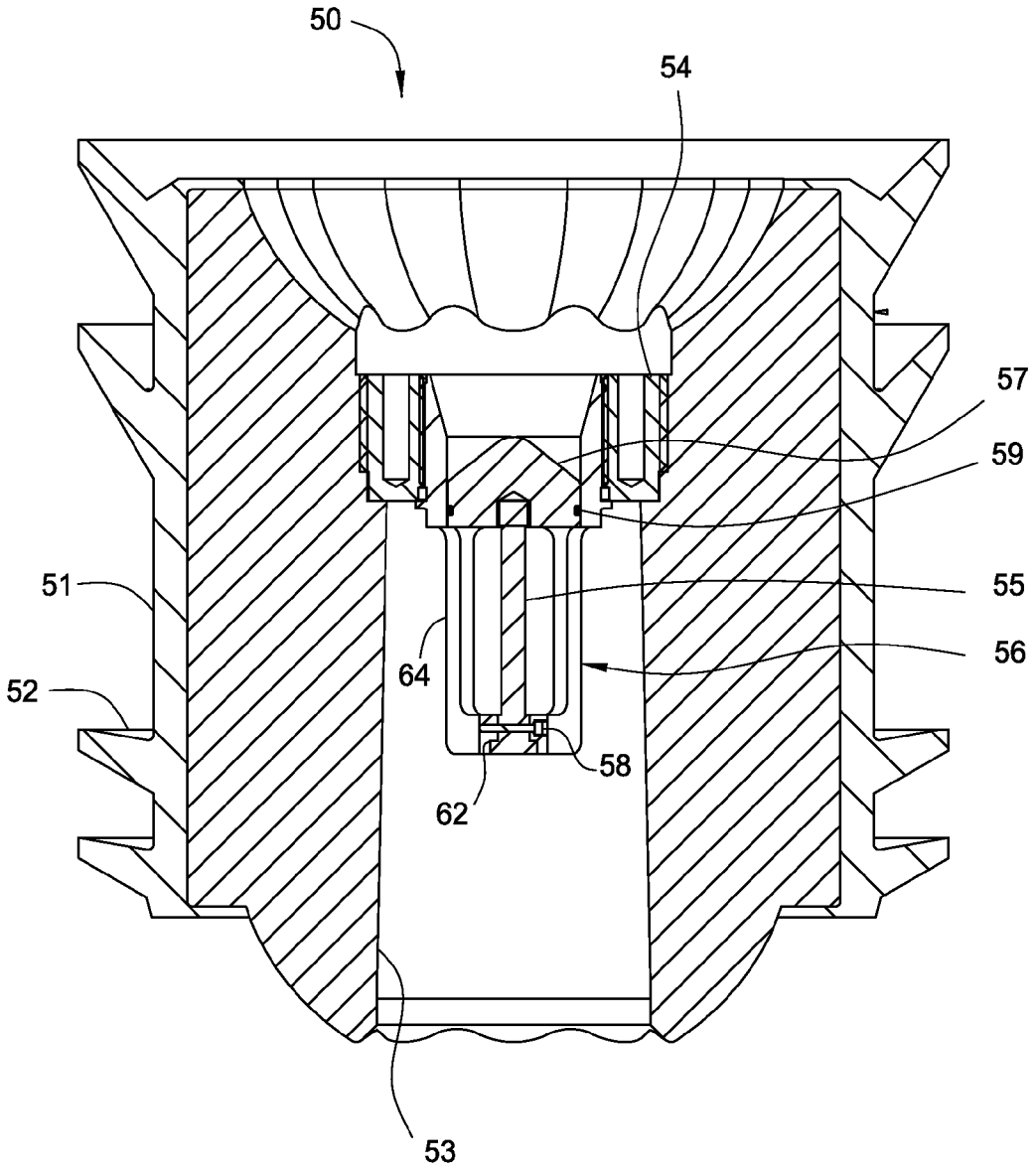
FIG. 2 illustrates an exemplary plug suitable for use with the dual gradient system of FIG. 1.

FIG. 2 illustrates another exemplary pump down plug 50. The plug 50 includes a housing 51 having one or more fins 52 on the exterior and a bore 53 extending through an interior. A catcher 56 is positioned in the bore 53 either directly or by using a connector 54. The catcher 56 may be a cage like structure having a plurality of openings formed between a plurality of legs 64 for allowing fluid flow. A piston 55 is selectively coupled to the catcher 56. In one embodiment, the piston 55 includes a piston head 57 disposed in an upper portion of the catcher 56. A sealing member 59 such as an o-ring may be used to form a seal between the piston head 57 and the catcher 56. The lower portion of the piston 55 may be selectively attached to the catcher 56 using a shearable member 58 such as a shearable pin. The shearable member 58 is adapted to shear at a predetermined pressure differential. In one embodiment, the shearable member 58 is adapted to shear between a maximum pressure of 200 psi and a minimum pressure that exceeds the maximum pressure required to move the plug 50 downward. In one embodiment, the minimum pressure to shear the shearable member 58 allows for the uppermost shear range of the shearable member to exceed the maximum pressure required to move the plug 50 downward plus a safety margin. For example, if the plug 50 is pumped down with a maximum pressure of 50 psi, then the shear pressure should be at least 100 psi for a safety factor of two and less than 200 psi. In other examples, safety factor may be between 1.2 to 4 times to the maximum pump down pressure. In the initial position, the piston head 57 prevents fluid flow through the bore 53 of the plug 50. After the shearable member 58 is sheared, the piston head 57 is allowed to fall relative to the catcher 56, thereby opening the bore 53 for fluid communication. In another embodiment, the lower portion of the piston 55 may optionally include a shoulder 62 to prevent shearing of the pin 58 by a pressure below the plug 50. In another embodiment, the pump down plug may be adapted to receive a ball or another dropped object. The ball may land in the plug and allow fluid pressure to build behind the plug. The increased pressure will urge the plug to move downward. After stopping at the desired position, pressure may be increased to remove the ball, thereby reestablishing fluid communication through the plug again. In yet another embodiment, a shearable sleeve may be used in place of the piston to block flow through the plug until sufficient pressure is built up behind the plug to shear the sleeve and allow flow through the plug.

In operation, a casing 40 is run-in to support the uncased portion of the wellbore 10. The casing 40 may be hung off of the wellhead 17 or hung off from the existing casing 20 at a location below the wellhead 17. During run-in, the low density fluid 31 such as seawater or a low density mud at 8.6 ppg in the riser 15 is allowed to enter the casing 40 through the autofill float shoe 45. The casing 40 is lowered until the bottom of the casing 40 is located in the region of the interface 32, as shown in FIG. 1. It must be noted that although the casing 40 is shown located in the high density fluid 31 below the interface 32, it is contemplated that the casing 40 may be located just above the interface 32 in the low density fluid 33. In this example, the high density fluid may be a high density mud having a density between 12-15 ppg. Exemplary high density fluids include any fluid or mud suitable for use in drilling operations. In one embodiment, the density selected is sufficient to maintain control of the well without fracturing the formations in the wellbore.

In one embodiment, after reaching the region of the interface 32, the pump down plug 50 is inserted into the casing 40 and pumped down the bore of the casing 40 to displace the light density fluid below the plug 50 out of the casing 40. This embodiment is particularly useful when the length of casing 40 is longer than the water depth to the sea floor. Before release, the plug 50 may be positioned in a pup joint or casing joint that is connected to the casing 40. This pup joint or casing joint may have an inside diameter that is larger than the inside diameter of the casing 40 above and/or below the position of the plug 50. The larger diameter keeps the plug 50 from falling from the joint as it is lifted for insertion in the casing string. Other mechanisms of retaining the plug may be used, such as a series of grooves that engage the plug fins or alternatively a drillable retainer that is smaller than the drift I.D. of the casing. A push fluid such as a high density fluid is supplied behind the plug 50 to urge the plug 50 down the casing 40. FIG. 1 shows the plug 50 traveling downward in the casing 40. In one embodiment described herein, the high density fluid is the same high density mud 33 disposed in the uncased portion of the wellbore 10, although it is contemplated that they could be different fluids. In another embodiment, the push fluid may have a density between 12-21 ppg. As the plug 50 is pumped down, the low density mud in the casing 40 is forced out of the casing 40 through the float shoe 45. The displaced light density fluid may be removed from the riser 15 at or near the interface 32 by the lift pump 27, or may cause an overflow of light density fluid into a discharge line near the top of the riser 15.

After the plug 50 lands in the landing collar 48, pressure is increased behind the plug 50 in order to shear the pin 58. For example, the pressure may be increased to 150 psi to shear the pin 58, thereby opening the plug 50 for fluid flow therethrough. The high density mud 33 in the casing 40 then flows out and mixes with the light density mud 31 in the riser 15. Mixing of the high and low density muds 33, 31 may cause a change in the pressure condition of wellbore. In response, the lift pump 27 may be operated to maintain the pressure condition of the wellbore 10 by removing the mixed muds from the interface 32 via the return line 26.

Figure 3:
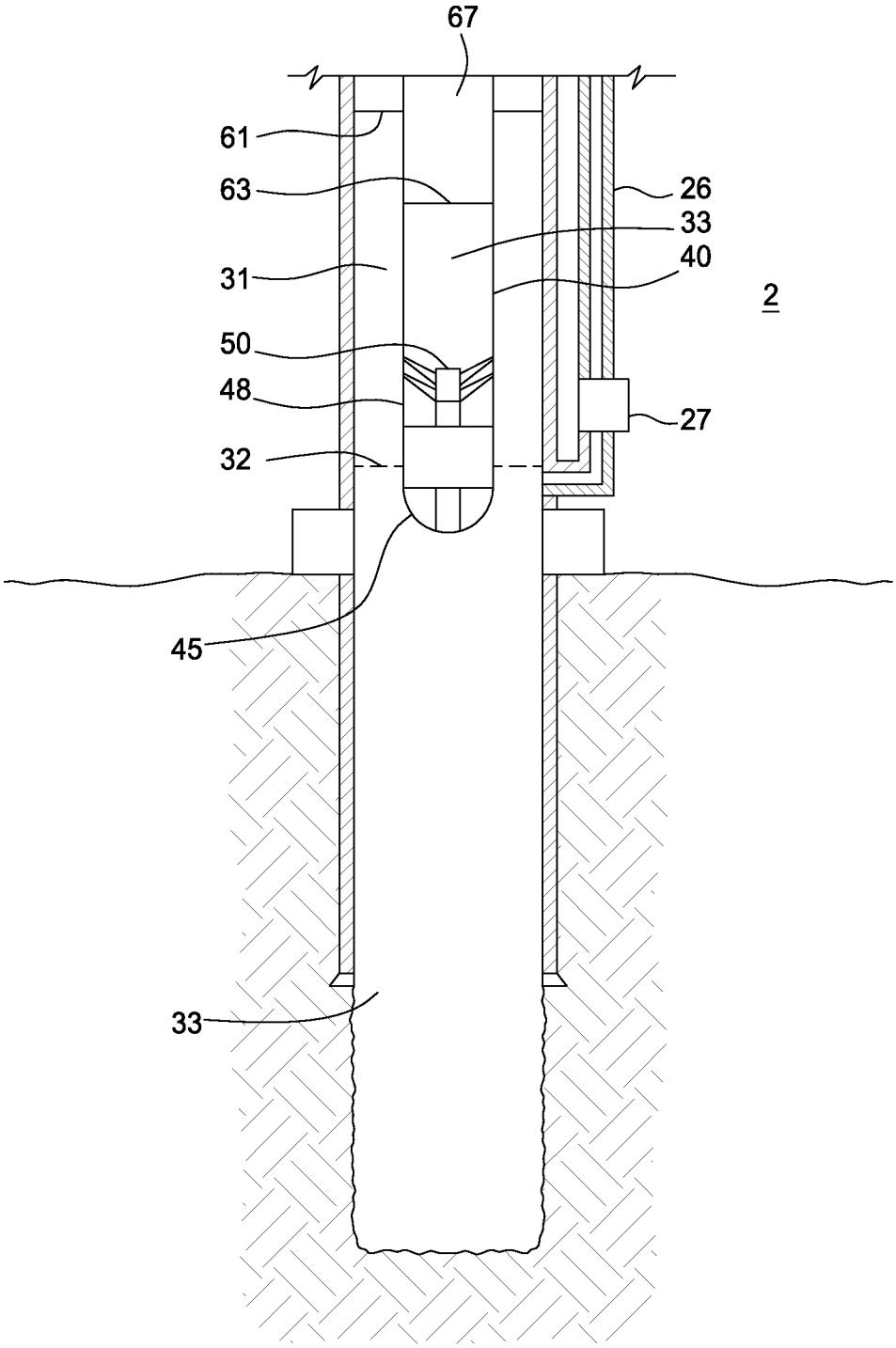
FIG. 3 illustrates a step of running casing in the dual gradient system of FIG. 1.

In one embodiment, the lift pump 27 may continue to pump the muds 31, 33 until the hydrostatic head caused by the level 63 of the high density mud 33 in the casing 40 is equal to the hydrostatic head caused by the level 61 of the low density mud 31 in the riser 15, as illustrated in FIG. 3. The area 67 above the high density fluid 33 in the casing 40 may contain air. Thereafter, the casing 40 is lowered into the wellbore 10 toward the uncased portion. The introduction of the casing 40 into the wellbore 10 may cause the high density mud 33 in the wellbore 10 to be displaced upward. Constant pressure at the interface 32 is maintained by removing the displaced high density mud 33 using the pump 27, thereby maintaining the dual gradient effect. Some of the high density mud 33 enters the casing 40 through the autofill float shoe 45 and enters the empty area 67 in the casing 40. In another embodiment, the casing 40 may be lowered before the hydrostatic equilibrium is reached.

Figure 4:
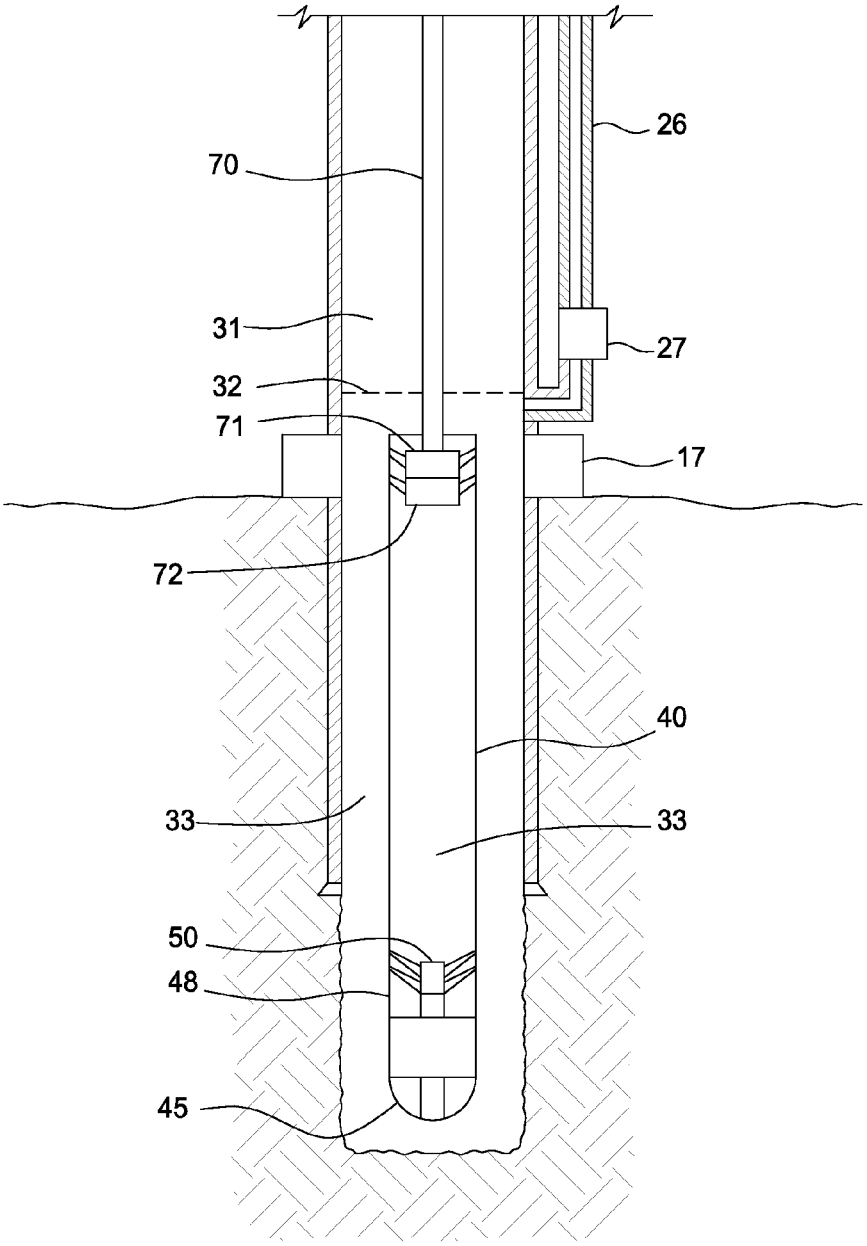
FIG. 4 illustrates another step of running casing in the dual gradient system of FIG. 1.

After the proper length of casing 40 has been run, a conveyance string such as a pipe landing string 70 is connected to the casing 40, as illustrated in FIG. 4. A subsurface plug release system having a top plug 71 and a bottom plug 72 may be attached to the distal end of the landing string 70. The casing 40 continues to be lowered until the casing 40 lands in the wellhead 17. For clarity, a casing hanger is not shown. Then the pressure inside the casing 40 is increased in order to convert the autofill float shoe 45 to a one way valve that prevents the inflow of fluid. In this manner, a casing 40 may be run in the dual gradient system with minimal pressure surge and with minimal contamination of the low and high density muds in the casing 40.

After conversion, the casing 40 is ready for the cementing operation. The top and bottom plugs 71, 72 may be released in the appropriate order as is known to a person of ordinary skill. For example, the bottom plug 72 may be released in front of the cement to separate the cement from the high density mud. The bottom plug 72 may be released using a first dart dropped from the rig. Then the top plug 71 is released to separate the cement from a push fluid, such as the high density mud. The top plug 71 may be released using a second dart dropped from the rig. After the bottom plug 72 lands on the pump down plug 50, pressure is increased to break a rupturable membrane in the bottom plug 72. In another embodiment, top and bottom cement plugs may be released from the surface, such as using a cementing head. The cement is then urged out of the casing 40 to fill the annulus. The cement is squeezed out until the top plug 71 lands on the bottom plug 72 or calculated displacement is reached. Thereafter, the cement is allowed to cure.

Figure 5:
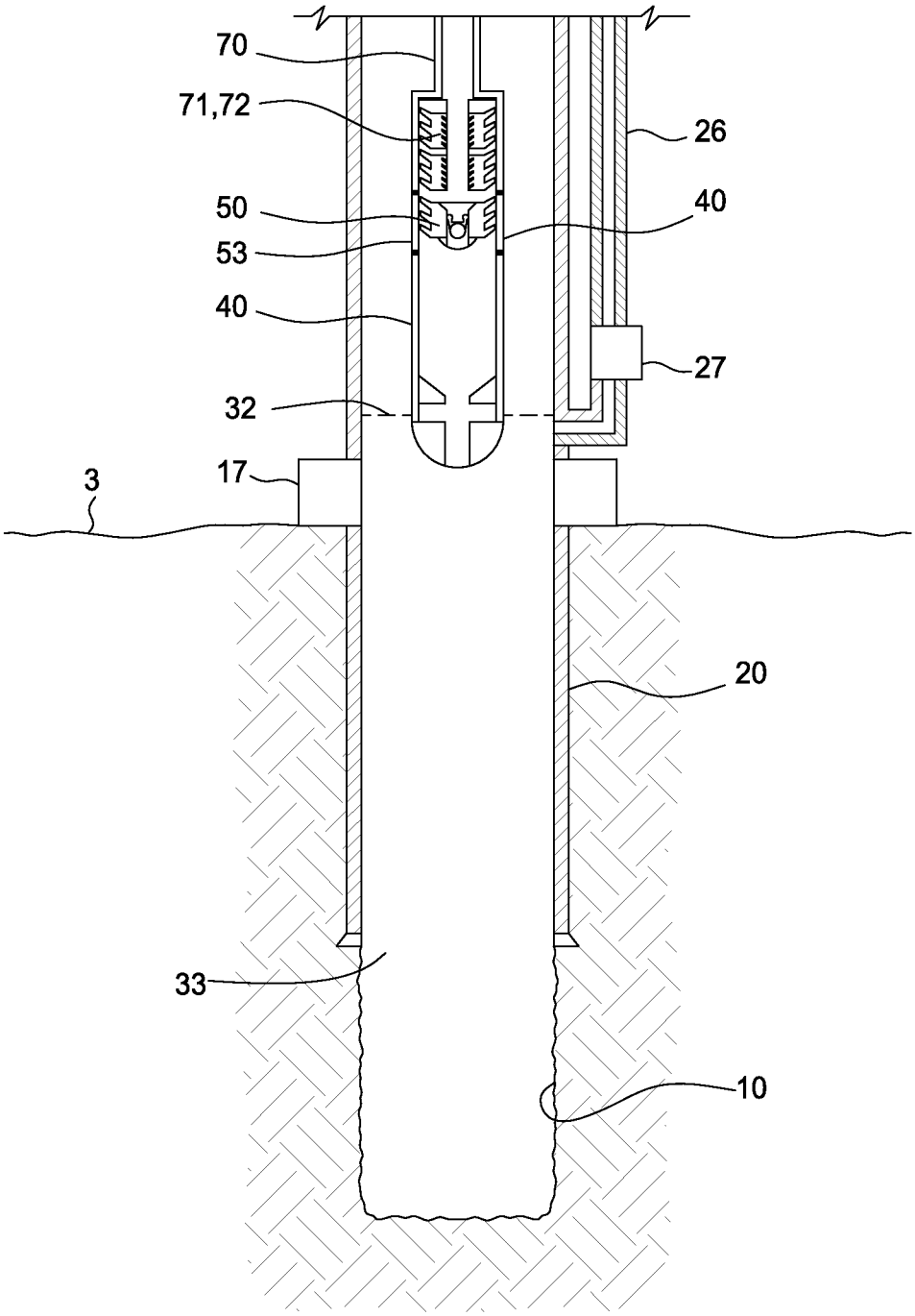
FIG. 5 illustrates another exemplary dual gradient system.

In another embodiment, where the length of casing 40 is shorter than the water depth, the plug 50 may be positioned in the casing 40 as the casing 40 is made up. In one example, as shown in FIG. 5, one or more subsurface release plugs 71, 72 may be positioned behind the pump down plug 50. The pump down plug 50 may be inserted into a pup joint 53 as described previously. The casing 40 with plugs 50, 71, 72 at the top end are lowered using a conveyance string such as a landing string 70. In this embodiment, a high density mud may be supplied behind the plugs 50, 71, 72 as the casing string 40 is run-in to prevent the plugs 50, 71, 72 from being forced upward as the casing 40 is run in and to reduce the amount of light density fluid that must be removed from the casing 20 when the casing 40 reaches the interface. Thus, in this embodiment, the plugs 50, 71, 72 are already disposed in the casing 40 when the casing 40 reaches the interface 32 or the well head 17. The casing 40 may be lowered into the high density fluid in accordance with the methods described above.

In one embodiment, a method of running casing in a dual gradient system includes lowering a casing into a low density fluid region and allowing the low density fluid to enter the casing; releasing a plug into the casing; supplying a high density fluid behind the plug, thereby urging the low density fluid out of the casing; and lowering the casing into a high density fluid region until target depth is reached.

In another embodiment, a method of running casing in a dual gradient system includes lowering a casing into a low density fluid region and allowing a low density fluid to enter the casing; supplying a high density fluid into the casing, wherein the high density fluid is behind the low density fluid; displacing the low density fluid out of a bottom end of the casing; and lowering the casing into a high density fluid region until target depth is reached.

In one or more embodiments described herein, the method includes operating a pump to maintain the dual gradient effect.

In one or more embodiments described herein, the method includes urging the high density fluid out of the casing until a hydrostatic head of the high density fluid is substantially the same as a hydrostatic head of the low density fluid.

In one or more embodiments described herein, the method includes lowering the casing to a location proximate an interface between the low and high density fluid regions before releasing the plug.

In one or more embodiments described herein, lowering the casing into the high density fluid region is performed after the hydrostatic head equilibrium is substantially reached.

In one or more embodiments described herein, the method includes operating a pump to maintain the dual gradient effect while the high density fluid is being urged out of the casing.

In one or more embodiments described herein, the method includes operating a pump to maintain the dual gradient effect while lowering the casing into the high density fluid region.

In one or more embodiments described herein, a plug includes a housing; a plurality of fins disposed on an exterior of the housing; a bore extending through the housing; a catcher attached to the bore; and a piston releasably attached to the catcher, wherein the piston forms a seal with the catcher to selectively block fluid flow through the bore.

In one or more embodiments described herein, the catcher includes one or more windows for fluid flow.

While the foregoing is directed to embodiments of the present invention, other and further embodiments of the invention may be devised without departing from the basic scope thereof, and the scope thereof is determined by the claims that follow.

The invention claimed is:

1. A method of running casing in a dual gradient system, comprising:

lowering a casing into a low density fluid region such that low density fluid enters the casing, the casing being lowered until a bottom end of the casing is proximate an interface between the low density fluid region and a high density fluid region;

releasing a plug into the casing while the bottom end is proximate the interface;

supplying a high density fluid behind the plug; and subsequently lowering the casing until a target depth is reached, the target depth being located in the high density fluid region.

2. The method of claim 1, further comprising operating a pump to maintain the interface.

3. The method of claim 1, further comprising pumping the high density fluid out of the casing until a hydrostatic head equilibrium is substantially reached, the hydrostatic head equilibrium being a condition in which a hydrostatic head of the high density fluid is substantially the same as a hydrostatic head of the low density fluid.

4. The method of claim 3, wherein lowering the casing into the high density fluid region is performed after the hydrostatic head equilibrium is substantially reached.

5. The method of claim 1, further comprising urging the high density fluid out of the casing until a hydrostatic head of the high density fluid is substantially the same as a hydrostatic head of the low density fluid.

6. The method of claim 1, further comprising operating a pump to maintain the interface between the low and high density fluid regions while lowering the casing into the high density fluid region.

7. The method of claim 1, further comprising urging the low density fluid out of the casing.

8. The method of claim 1, further comprising:

retaining the plug in the casing using at least one of one or more grooves in a pup joint, a removable retainer, a drillable retainer, and combinations thereof; and releasing the plug using an applied pressure or force.

9. The method of claim 1, wherein the plug comprises:

a housing;

a plurality of fins disposed on an exterior of the housing;

a bore extending through the housing;

a catcher attached to the bore; and a piston releasably attached to the catcher, wherein the piston forms a seal with the catcher to selectively block fluid flow through the bore.

10. The method of claim 1, further comprising:

attaching a conveyance string to the casing; and lowering the conveyance string before releasing the plug.

11. The method of claim 10, further comprising positioning one or more subsurface release plugs above the plug.

12. The method of claim 1, further comprising positioning the plug in a pup joint connected to the casing.

13. The method of claim 12, further comprising:

retaining the plug in the pup joint using at least one of one or more grooves in the pup joint, a removable retainer, a drillable retainer, and combinations thereof; and releasing the plug using an applied pressure or force.

14. The method of claim 1, wherein the plug comprises:

a housing;

a plurality of fins disposed on an exterior of the housing;

a bore extending through the housing; and a rupture disc for blocking fluid flow through the bore.

15. The method of claim 1, wherein the bottom end of the casing is located above the interface of the dual gradient system when the bottom end of the casing is proximate the interface.

16. The method of claim 1, wherein the bottom end of the casing is located below the interface of the dual gradient system when the bottom end of the casing is proximate the interface.

17. A method of running casing in a dual gradient system, comprising:

lowering a casing into a low density fluid region such that low density fluid enters the casing;

positioning a bottom end of the casing proximate an interface of the dual gradient system located between the low density fluid region and a high density fluid region, the bottom end of the casing being located above the interface of the dual gradient system, the interface being external of the casing;

supplying a high density fluid into the casing behind the low density fluid, the high density fluid displacing the low density fluid out of a bottom end of the casing while the bottom end of the casing is proximate the interface; and subsequently lowering the casing to a target depth within the high density fluid region.

18. The method of claim 17, further comprising pumping the high density fluid out of the casing until a hydrostatic head equilibrium is substantially reached, the hydrostatic head equilibrium being a condition in which a hydrostatic head of the high density fluid is substantially the same as a hydrostatic head of the low density fluid.

19. The method of claim 18, wherein lowering the casing to the target depth is performed after the hydrostatic head equilibrium is substantially reached.

20. The method of claim 17, further comprising urging the high density fluid out of the casing until a hydrostatic head of the high density fluid is substantially the same as a hydrostatic head of the low density fluid.

21. The method of claim 17, further comprising operating a pump to maintain the interface of the dual gradient system while lowering the casing to the target depth.

22. A method of running casing, the method comprising:

lowering a casing into a subsea riser, the subsea riser being fluidly connected with a wellbore and having a dual gradient system, the dual gradient system including a low density fluid and a high density fluid, the low density fluid being located above the high density fluid, an interface existing within the dual gradient system between the low and high density fluids;

positioning a bottom end of the casing proximate the interface;

urging a plug downwardly into the casing with a push fluid while the bottom end of the casing is proximate the interface, the plug urging low density fluid within the casing out of the bottom end of the casing as the plug is pumped downwardly, the push fluid being more dense than the low density fluid of the dual gradient system; and lowering the casing further until a target depth below the interface is reached.

23. The method of claim 22, further comprising operating a pump to maintain the interface of the dual gradient system while lowering the casing towards the target depth.

24. The method of claim 22, wherein a density of the push fluid is substantially similar to a density of the high density fluid.

* * * * *